US006186687B1

(12) United States Patent
Fuchs et al.

(10) Patent No.: US 6,186,687 B1
(45) Date of Patent: Feb. 13, 2001

(54) FOUNTAIN PEN

(75) Inventors: Eckhard Fuchs, Hamburg; Rüdiger Weiss, Buchholz; Thomas Klössing, Kiel; Dietmar Podszuweit, Hamburg; Heino Strehle, Nahe, all of (DE)

(73) Assignee: Montblanc-Simplo GmbH, Hamburg (DE)

( * ) Notice: Under 35 U.S.C. 154(b), the term of this patent shall be extended for 0 days.

(21) Appl. No.: 09/272,623

(22) Filed: Mar. 19, 1999

(30) Foreign Application Priority Data

Mar. 19, 1998 (DE) ..... 198 13 153

(51) Int. Cl.[7] ..... B43K 5/16
(52) U.S. Cl. ..... 401/116; 401/99; 401/243
(58) Field of Search ..... 401/116, 117, 401/222, 241, 243, 250, 251, 134

(56) References Cited

U.S. PATENT DOCUMENTS

| | | | | |
|---|---|---|---|---|
| 700,909 | * | 5/1902 | Frazer | 401/116 |
| 897,892 | * | 9/1908 | Hamilton | 401/116 |
| 3,203,403 | | 8/1965 | Yanagita et al. . | |
| 3,645,636 | * | 2/1972 | Mutschler | 401/227 |
| 4,172,674 | * | 10/1979 | Paroty | 401/116 |

FOREIGN PATENT DOCUMENTS

| | | |
|---|---|---|
| 196 33 242 A1 | 2/1998 | (DE) . |
| 1539276 | 9/1966 | (FR) . |

* cited by examiner

*Primary Examiner*—Henry J. Recla
*Assistant Examiner*—Huyen Le
(74) *Attorney, Agent, or Firm*—Nixon & Vanderhye P.C.

(57) ABSTRACT

A fountain pen is provided with a tubular barrel, and ink guide with a nib on its front end and a cartridge on its rear end. The ink guide is mounted so that it is substantially linearly movable not only between a writing position in which the tip of the nib projects out of the front end of the barrel, and a storage position in which the nib is retracted within the barrel, but also a replacement position in which the rear end of the cartridge projects out of the open rear end of the barrel so that the cartridge can be readily grasped for replacement. A cover cap may be provided with an axially extending support pin having a free end which engages a pivotal closure cap to prevent it from opening the rear end of the barrel as a result of pressure exerted by the ink cartridge. The free end of the support pin also engages the ink guide, when the pen is in the writing position and the cover cap surrounds the front end of the barrel, to insure that the tip of the nib is spaced from all portions of the cover cap.

21 Claims, 8 Drawing Sheets

FOUNTAIN PEN

BACKGROUND AND SUMMARY OF THE INVENTION

The invention relates to a fountain pen with a tubular barrel, an ink guide mounted in the barrel and having a nib attached to the front end thereof, and an ink reservoir in the form of an ink cartridge fitted onto the rear end of the ink guide. The ink guide is displaceable (substantially linearly movable) between a writing position in which its front end area projects out of the front end of the barrel, and a storage position in which the front end area of the ink guide, and the nib attached to it, are retracted into the barrel. In known fountain pens of this kind (such as in French Patent 1 539 276 and U.S. Pat. No. 3,203,403), the fitting of a new ink cartridge and the removal of an empty cartridge, are carried out in such a way that a rear part of the tubular barrel is removed from the front part of the tubular barrel so that the ink cartridge becomes accessible and can be gripped and pulled out of the barrel, and a new ink cartridge fitted onto the rear end area of the ink guide.

The invention provides a fountain pen with retractable ink guide and nib that allows the ink cartridge to be replaced easily, more easily than in the prior art. This is accomplished by providing a pen wherein the ink guide can be moved from the storage position into a replacement position in which the rear end of the ink cartridge fitted in or on the ink guide projects out of the rear end of the barrel, and can be readily grasped for removal.

The fountain pen according to the invention is thus, as is conventional, fitted with a replaceable ink cartridge which forms the ink reservoir and is positioned on the rear end of the ink guide so that, in a conventional manner, ink from it can enter through a central opening of the ink guide into the latter and pass forward to the nib. However, to allow the ink cartridge to be easily replaced, without disassembling the barrel, the ink guide is movable into a replacement position, rearward of the storage position, in which the fitted ink cartridge is located wholly inside the barrel. In the replacement position, the rear end of the ink cartridge projects out of the rear end of the barrel so that the user can grasp the ink cartridge and pull it off of the rear end of the ink guide in order to replace it with a new full ink cartridge.

In a preferred embodiment of the invention, a closure cap is pivotally mounted near or at the rear end of the barrel so that the barrel rear open end is covered by the closure cap in normal operation. When the closure cap is moved into its opening position the ink guide may be moved from the storage position into the replacement position in order that the rear end of the barrel is open to receive the ink cartridge.

To facilitate the displacement movement of the ink guide between the writing position, storage position, and replacement position, a positioning sleeve can be provided that is rotatable with respect to, but axially non-displaceable in, the barrel. The sleeve has a thread-like track engageable by at least one catch, non-displaceably connected to the ink guide. In this way, when the positioning sleeve is rotated, a helical displacement (substantially linear) movement of the catch is effected relative to the positioning sleeve and thus a corresponding axial displacement movement of the ink guide. A particularly uniform displacement (substantially linear) movement results if the track is shaped as a double thread and two catches are arranged diametrically opposite each other on the ink guide.

To achieve a simple construction of the ink guide, the at least one catch may be provided on a bushing which is attached to the rear end of the ink guide. This enables the ink guide to be developed and manufactured according to conventional requirements, while the bushing is connected to the finished ink guide in a separate procedure.

To indicate to the user, during use, that the storage position has been reached, and to be able to interrupt ink guide movement in one direction or the other, the track may have at least one section which has a reduced pitch and defines the storage position. A supporting surface for the at least one catch may be present at the front end of the track, through which the writing pressure occurring during use and acting on the ink guide is absorbed.

The barrel may, in a manner conventional per se, have a front external thread for receiving one cover cap enclosing its front end. Optionally, the cover cap can be attached by simply pushing it on. If a screwable cover cap is provided, a rear external thread can be provided adjacent the rear end area of the positioning sleeve for receiving the cover cap. In this way, the cover cap can be coupled with the rotatable positioning sleeve and the positioning sleeve rotated by rotating the cover cap. That is, in a particularly preferred embodiment of the invention, the closure cap is fastened to the rear end of the positioning sleeve so that the user can grasp the closure cap, and rotate it to thereby rotate the positioning sleeve to move the ink guide into the desired position.

In order [when the cover cap and thus the positioning sleeve are rotated in the direction of movement of the ink guide from the writing position into the storage position] to prevent the cover cap from being detached from the positioning sleeve before the storage position has been reached, the core diameter of the rear external thread and/or the outer diameter of the internal thread of the cover cap can change in the axial direction so that the clamping force established between the positioning sleeve and the cover cap screwed thereon is greater than the force to be exerted on the cover cap to displace the ink guide from the writing position into the storage position. The core diameter of the rear external thread is preferably constant, and the outer diameter of the inner thread of the cover cap changes, resulting in a taper from front to back with a cone opening angle of between about 10° and 16°, preferably about 12°. In this case, the front external thread is preferably formed with essentially the same pitch from the rear forward, to avoid an increased clamping force arising in this area.

The clamping force thus established between the rear external thread and the internal thread of the cover cap leads to a coupling of cover cap and positioning sleeve which ensures that the substantially linear movement of the ink guide from the writing position into the storage position can be undertaken by rotating the cover cap and that the cover cap is unscrewed from the positioning sleeve only when the ink guide has reached the storage position. The detached cover cap can then be screwed onto the front external thread in order to protect ink on or in the nib and the ink guide from drying out.

As previously mentioned, the track may have at least one section which has a reduced pitch and defines the storage position in order that, upon movement of the ink guide from the writing position into the storage position, the user can detect that the storage position has been reached and, if the positioning sleeve has a rear external thread for receiving and clamping the cover cap, to generate a resistance to such a further displacement that the cover cap detaches itself from the rear external thread.

If a closure cap is fixed in a pivotal manner to the rear end of the positioning sleeve, the definition or establishment of the storage position by a section with reduced pitch in the track may be dispensed with, and the storage position can be defined by the abutment of the rear end of the ink cartridge against the front surface of the closure cap.

While the cover cap normally separates from the rear external thread if the abutment of the rear end of the ink cartridge against the closure cap causes a certain resistance against further rearward displacement of the ink guide, it cannot be ruled out that the clamping force between cover cap and rear external thread is so great that the user undesirably moves the ink guide (and thus the ink cartridge) further to the rear, despite its abutment against the closure cap, thus opening the closure cap. To avoid this and to achieve a defined storage position, an axially extending support pin may be provided in the base of the cover cap, the pin free end being located directly beside the rear surface of the closure cap when the cover cap is screwed onto the rear external thread, and preventing opening. Opening of the cover cap is prevented as a result of the pressure exerted on the closure cap by the rear end of the ink cartridge. In this way, the support pin blocks opening of the closure cap when the torque exerted on the positioning sleeve leads to a force in the direction of further rearward movement of the ink guide and thus of the ink cartridge. As a result, the closure cap can no longer be opened, rather the torque exerted by the user on the cover cap effects the detachment of the cover cap from the rear external thread.

The provision of the support pin in the base of the cover cap has the further advantage that when the cover cap is screwed onto the front external thread its free end engages, in a manner bracing the ink guide against further forward movement, a supporting surface of the ink guide when the latter is moved in the direction of the writing position so that the tip of the nib is always spaced from all portions of the cover cap. The supporting surface can comprise or consist essentially of the base surface of a blind bore in the ink guide. Thus, if, when the cover cap is screwed onto the front external thread, the user rotates the positioning sleeve, as by gripping the positioning sleeve in the area of the closure cap, he or she is thereby prevented from moving it so far out of the storage position in the direction of the writing position that the tip of the nib comes into contact with the cover cap. This could damage the tip. In particular, the contact between the tip of the nib and the cover cap could result (due to the resulting capillary effect) in ink being released from the ink guide via the tip of the nib into the inside of the cover cap, leading to significant blotting.

It is the primary object of the present invention to provide a fountain pen having an ink guide that can be moved from a storage position into a replacement position that allows simpler replacement of the ink cartridge than is possible in conventional fountain pens. This and other objects of the invention will become clear from an inspection of the detailed description of the invention and from the appended claims.

DETAILED DESCRIPTION OF THE DRAWINGS

Figure 1:
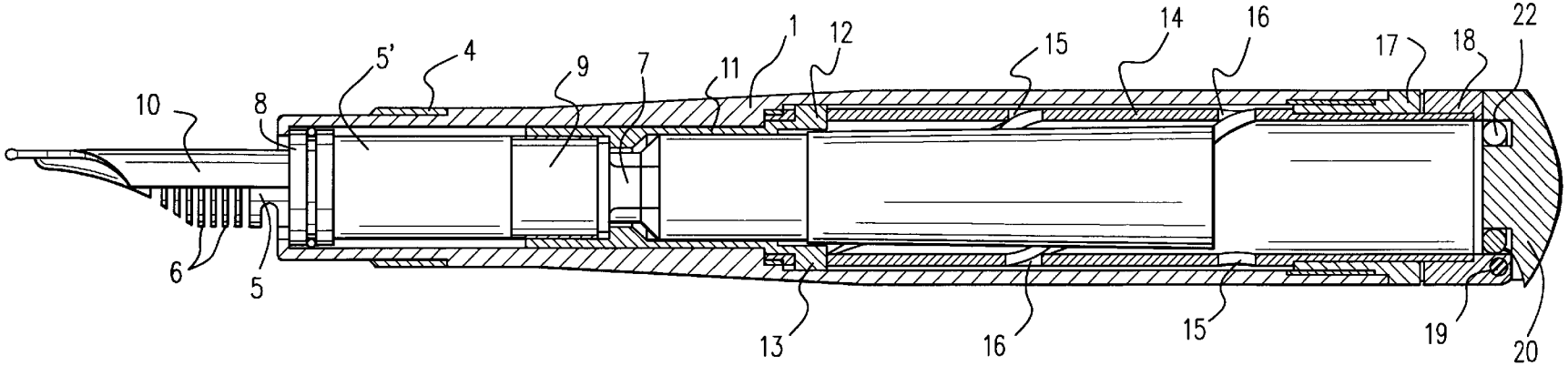
FIG. 1 is a side view of an exemplary fountain pen according to the invention in a writing position, illustrated partially in cross section and partially in elevation.

The exemplary fountain pen according to the invention illustrated in the drawings has a tubular barrel 1 which has, at its front end, an opening 2, whose diameter is somewhat reduced vis-a-vis the diameter of the neighboring section of the barrel 1. In the front area, an external thread 4 is formed on the barrel 1 spaced from the opening 2, onto which a cover cap [not shown in FIG. 1, but visible in the FIG. 7 embodiment] can be screwed, as is conventional per se.

Figure 2:
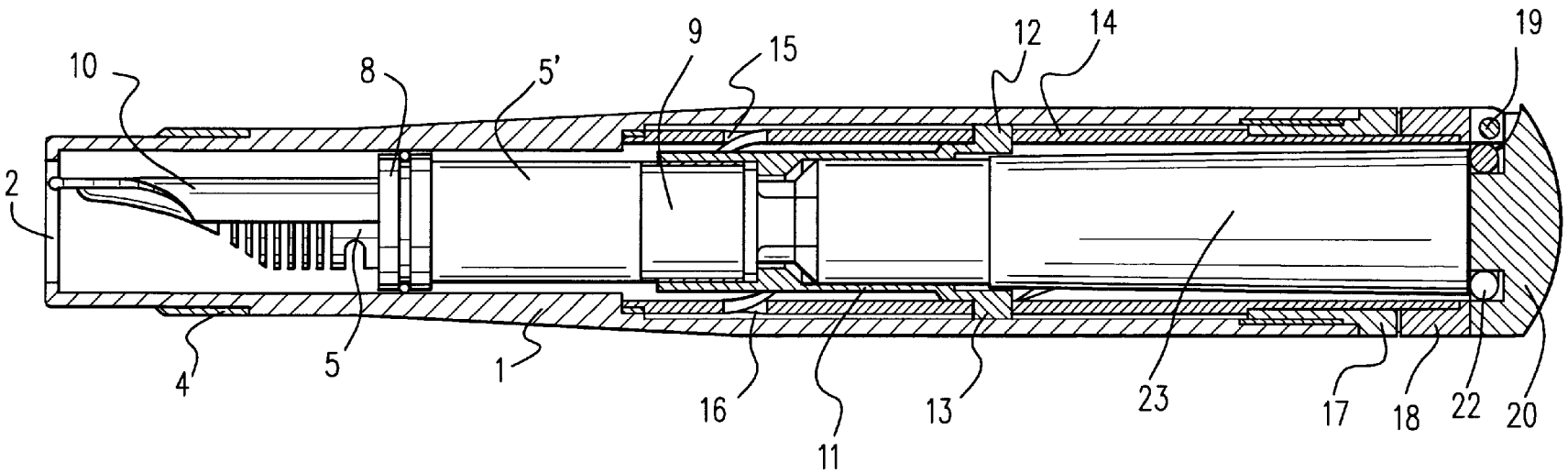
FIG. 2 is a view like that of FIG. 1 showing the fountain pen of FIG. 1 in a storage position.
Figure 3:
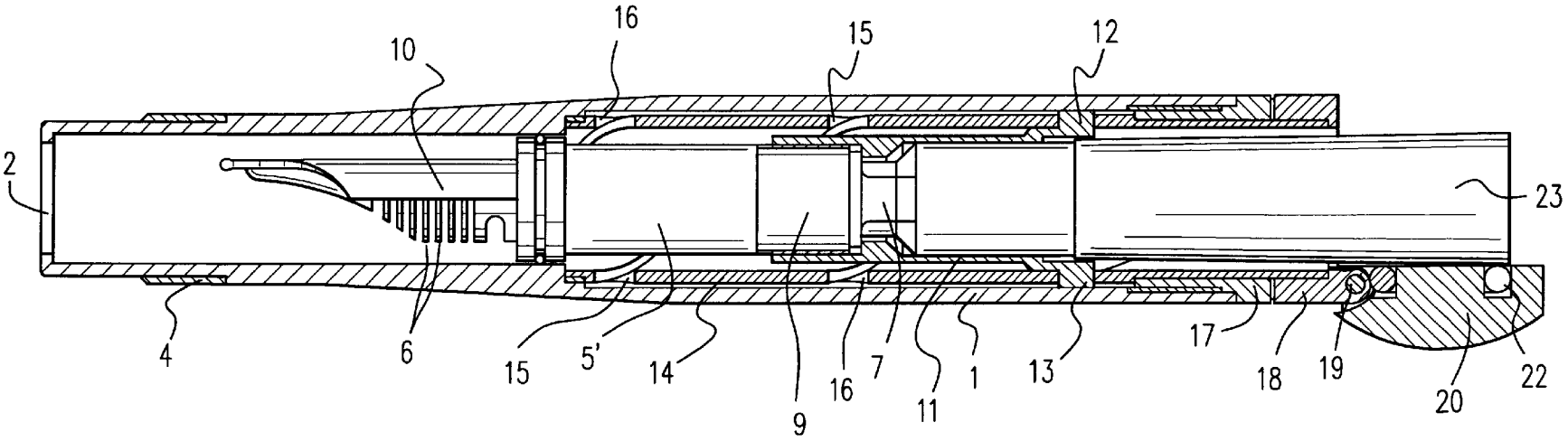
FIG. 3 is a view like that of FIGS. 1 and 2 showing the fountain pen in a replacement position.

Located in the front part of the barrel 1 is a conventional ink guide, which comprises or consists essentially of an ink guide sleeve 5' and an ink guide fitting 5 fitted therein. As seen in FIGS. 1 to 3, the fins 6 formed at the front end area of the ink guide fitting 5 hold ink, through capillary action, and represent a part of a conventional pressure equalization system. On the side radially opposite the fins 6, a nib 10 is releasably clamped between ink guide fitting 5 and ink guide sleeve 5', as is customary, the front end of rib 10 projecting over the front end of the ink guide fitting 5. On the front end area of the ink guide sleeve 5', there is an annular shoulder 8 which, in the writing position seen in FIG. 1, lies against the retracted area of the barrel 1 surrounding the opening 2, and thereby defines the front end position of the ink guide 5, 5' and thus of the nib 10. Between the annular shoulder 8 and a neighboring annular shoulder lying further back, the ink guide sleeve 5' has a conventional sealing ring.

At the rear end of the ink guide sleeve 5', an axial, cylindrical projection 7 is formed in a conventional manner, onto which the neck section of a conventional ink cartridge 23, e.g. a "Euro cartridge", is fitted so that the neck section of the ink cartridge 23 is clamped onto the projection 7. The projection 7, when the ink cartridge 23 is fitted thereon, also effects opening or piercing of the cartridge 23 seal, to allow ink to flow therefrom. The inside of the ink cartridge 23 is connected to the co-axial inner bore (not shown) of the ink guide sleeve 5' via the projection 7, so that in a conventional manner for such ink guides, a connection to the nib 10 is formed via the ink guide fitting 5 and the pressure equalization system which contains the fins 6.

A bushing 11 is fitted onto the rear area 9 of the ink guide sleeve 5' which at the front thereof joins onto the projection 7 and is connected to the ink guide sleeve 5', for example by cooperating screw threads. The rear area of the bushing 11 forms a cylindrical guide section for the front area of the ink cartridge 23. At the rear end of the bushing 11 at least one catch is provided (preferably two catches 12, 13, are formed, diametrically opposite each other and projecting radially outwardly). The catches 12, 13 may have a circular cross-section.

Inserted into the barrel 1 from the rear is a cylindrical positioning sleeve 14, which rests with its front end on an inner annular shoulder of the barrel 1 and is surrounded in this area by a metal ring. In an area lying further back, the positioning sleeve 14 has an annular shoulder on which an annular shoulder of a sleeve part 17 rests and which is fitted onto the barrel 1 from behind and rests with an outwardly directed annular shoulder on its rear end. Barrel 1 and sleeve part 17 are connected tightly to each other, for example by cooperating screw threads. In this way, the positioning sleeve 14 sits axially non-displaceable, but rotatable, between an inner annular shoulder of the barrel 1 and an annular shoulder of the sleeve part 17.

The positioning sleeve 14 has a rear section that projects over the rear end of the sleeve part 17, and a sleeve element 18 is fitted onto this section and, for example, screwed to the positioning sleeve 14. A closure cap 20 is pivotally mounted, via pivot axis 19, to the sleeve element 18 so that the cap 20 can pivot between open (FIG. 3) and closed (FIGS. 1 and 2) positions. In an annular groove provided on its inside, the closure cap 20 bears a snap ring 22 which is somewhat elastically compressed in its fitted state. When the closure cap 20 is closed (FIG. 2), the area of the snap ring 22 near the pivot axis 19 enters a recess formed at the rearward-projecting area of the sleeve element 18 so that a defined closure position for the closure cap 20 results.

In the area between the aforementioned annular shoulders, the positioning sleeve 14 has two thread-shaped cuts 15, 16 which have identical pitches and are offset 180°. At the front ends of cuts 15, 16 rectilinear introduction sections 15*b*, 16*b* (see FIG. 5) are formed. The thread-shaped cuts 15, 16 extend approximately 360° and have end sections 15*c*, 16*b*,extending in a peripheral direction. In the middle area of the cuts 15, 16, short intermediate sections 15*a*, 16*a* are formed running approximately in a peripheral direction. All of the two intermediate sections 15*a*, 16*a* and the two end sections 15*c*, 16*c* are provided at the same axial height.

As seen in FIGS. 1 to 3, the circular cylindrical projecting shoulders 12, 13 of the bushing 11 extend into the cuts 15, 16, the introduction of the catches 12, 13 into the cuts 15, 16 being provided by the introduction sections 15*b*, 16*b* formed at the front end of the positioning sleeve 14 and open to the front. The metal ring illustrated in FIGS. 1 to 3 surrounds the positioning sleeve 14 in the area of the cut sections 15*b*, 16*b* and prevents the catches 12, 13 from emerging out of the front ends of the cuts 15, 16 when the fountain pen is assembled. This movement of the catches 12, 13 is effected along the thread-shaped cuts 15, 16 by rotating the positioning sleeve 14 within the barrel 1 so that the ink guide 5, 5', and thus also the nib 10, are moved axially relative to the barrel 1.

It has been assumed with respect to the FIGS. 1 to 3 embodiment that upon movement into the different positions the barrel 1 (together with the positioning sleeve 14) rotates around the ink guide 5, 5' and bushing 11 so that the nib 10 always remains in the position shown.

Figure 5:
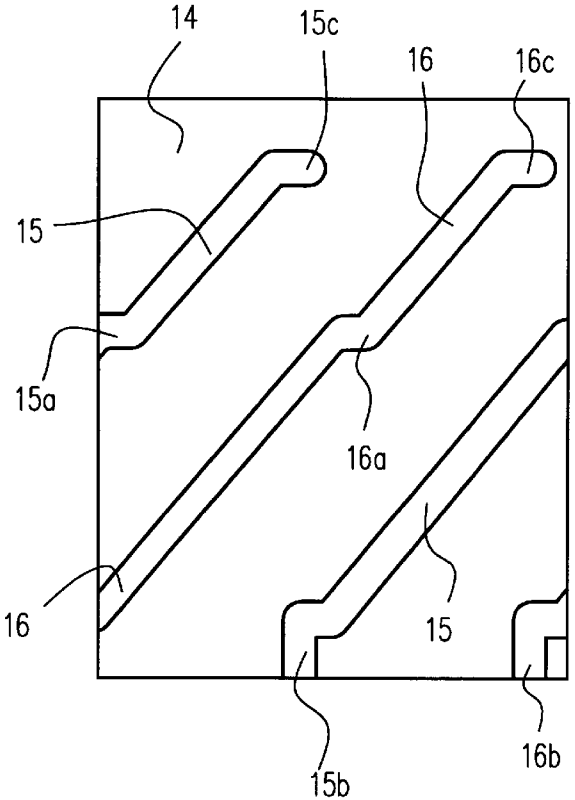
FIG. 5 is a developed detail view of the threaded configuration of the positioning sleeve of FIG. 4.
Figure 4:
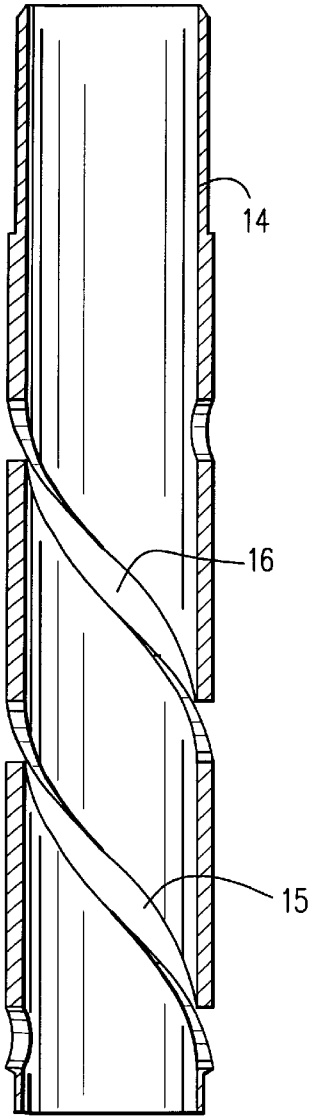
FIG. 4 is a longitudinal cross sectional view of the positioning sleeve of the fountain pen of FIGS. 1 to 3.

In the writing position of FIG. 1, the catches 12, 13 are located in their most forward end position occurring during use, and the ink guide sleeve 5' lies with its annular shoulder 8 on the recess of the opening 2 formed at the front end of the barrel 1. Thereby, no further forward movement the ink guide 5, 5' is possible. In this position, the catches 12, 13 are located in the transitional area between the introduction sections 15*b*, 16*b* and cuts 15, 16 connected thereto. In this transitional area, as shown in FIG. 5, a rear edge or supporting surface of each introduction section 15*b*, 16*b* runs in a peripheral direction so that in the writing position according to FIG. 1, sections 15*a*, 16*b* provide a support for the catches 12, 13. Thus the writing pressure acting on the nib 10 is absorbed by supporting the catches 12, 13 at these peripheral edges or surfaces.

To move the ink guide 5, 5' into the storage position of FIG. 2, the user opens the sealing cap 20 so that he or she can grasp it and with its help rotate the positioning sleeve 14 in the barrel 1. Thereby, the catches 12, 13 are displaced rearwards along the cuts 15, 16 until they reach the area of the intermediate sections 15*a*, 16*a* running in a peripheral direction, so that a slight "idling" or detent is detected by the user when the positioning sleeve 14 is rotated. This indicates to the user that the storage position of FIG. 2 has been reached in which the front end of the nib 10 no longer projects out of the front end of the barrel 1. The user can then shut the sealing cap 20 again so that the position shown in FIG. 2 results, and the user can screw the corresponding conventional cover cap (not shown) onto the external thread 4. Through a corresponding reverse sequence of movements, the fountain pen can be brought back into the writing position of FIG. 1.

If the ink cartridge 23 is empty, damaged, or to be replaced for any other reason, the user again opens the sealing cap 20 and rotates the positioning sleeve 14 in the same direction as when moving the ink guide 5, 5' from the writing position (FIG. 1) into the storage position (FIG. 2) so that the catches 12, 13 are moved further to the rear out of the intermediate sections 15*a*, 16*a* along the cuts 15, 16 until they enter the end sections 15*c*, 16*c* running in a peripheral direction. The ends of sections 15*c*, 16*c* limit this movement. Thereby, the replacement position of FIG. 3 is reached in which the rear end area of the ink cartridge 23 projects out of the open rear end of the barrel 1 and the components connected to it (namely sleeve part 17, positioning sleeve 14, and sleeve element 18), so that the rear end area of cartridge 23 can be grasped and the ink cartridge 23 removed. After a new ink cartridge 23 is fitted, the ink guide 5, 5' is moved forwardly by rotating the positioning sleeve 14, either into the storage position of FIG. 2, or immediately into the writing position of FIG. 1.

Figure 6:
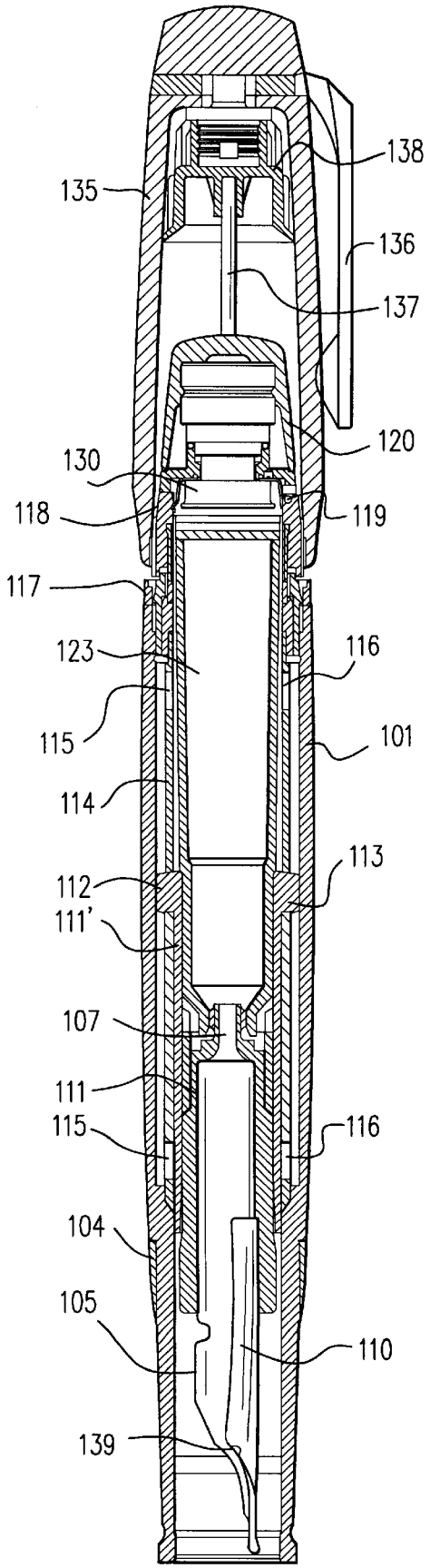
FIG. 6 is a side view, partly in cross section and partly in elevation, of another embodiment of a fountain pen according to the invention with the ink guide in the storage position and the cover cap screwed onto the rear end.
Figure 7:
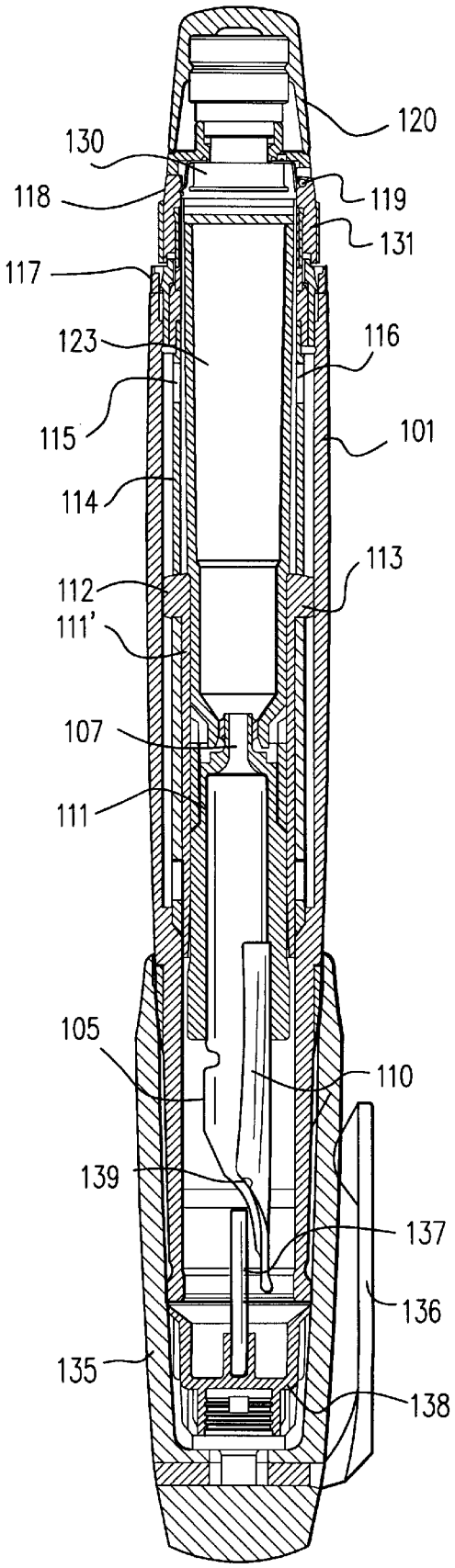
FIG. 7 shows the fountain pen of FIG. 6 with the cover cap screwed onto the front end.
Figure 8:
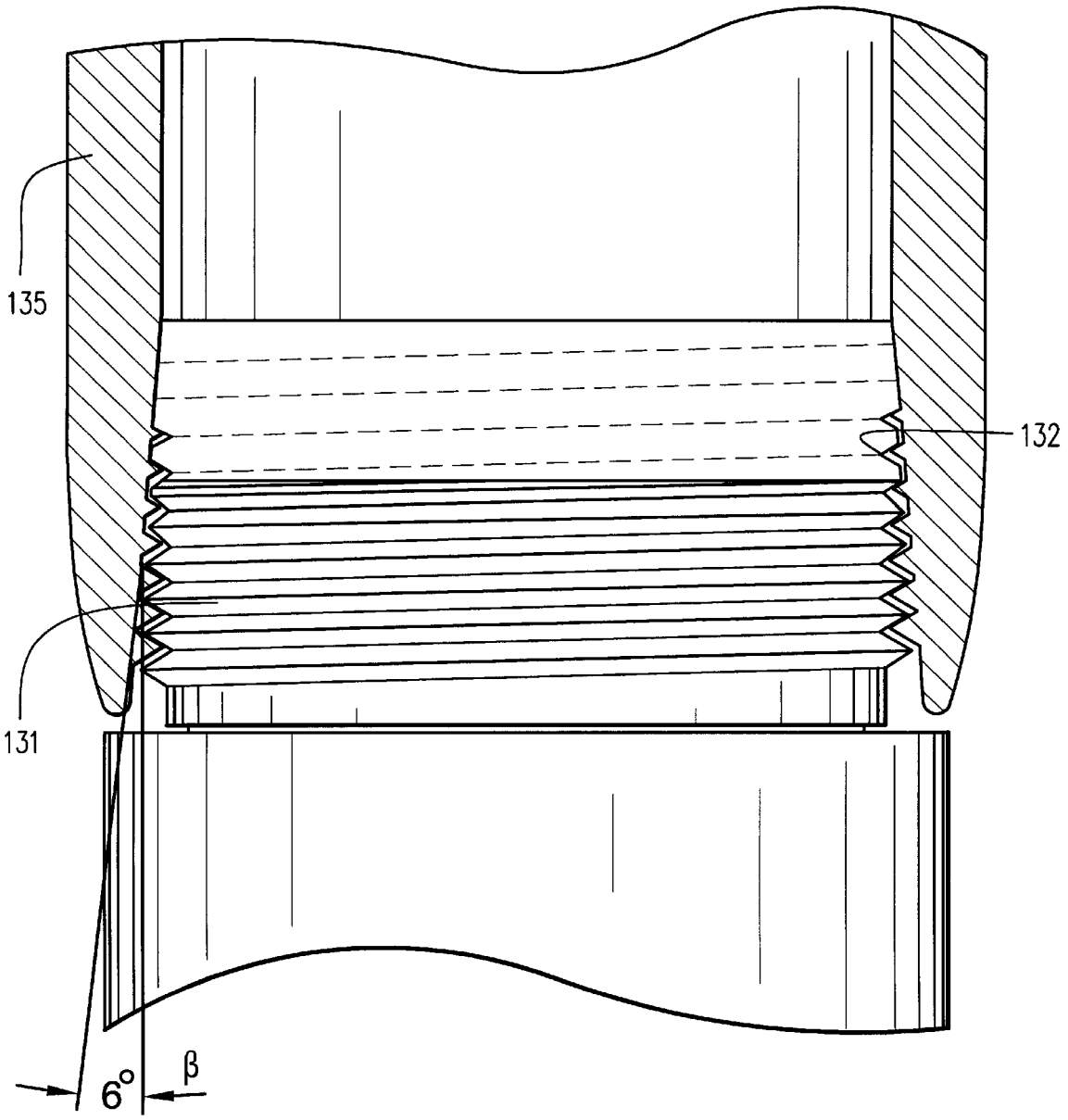
FIG. 8 is an enlarged detail view of the area around the rear external thread of the fountain pen of FIG. 6.
Figure 9:
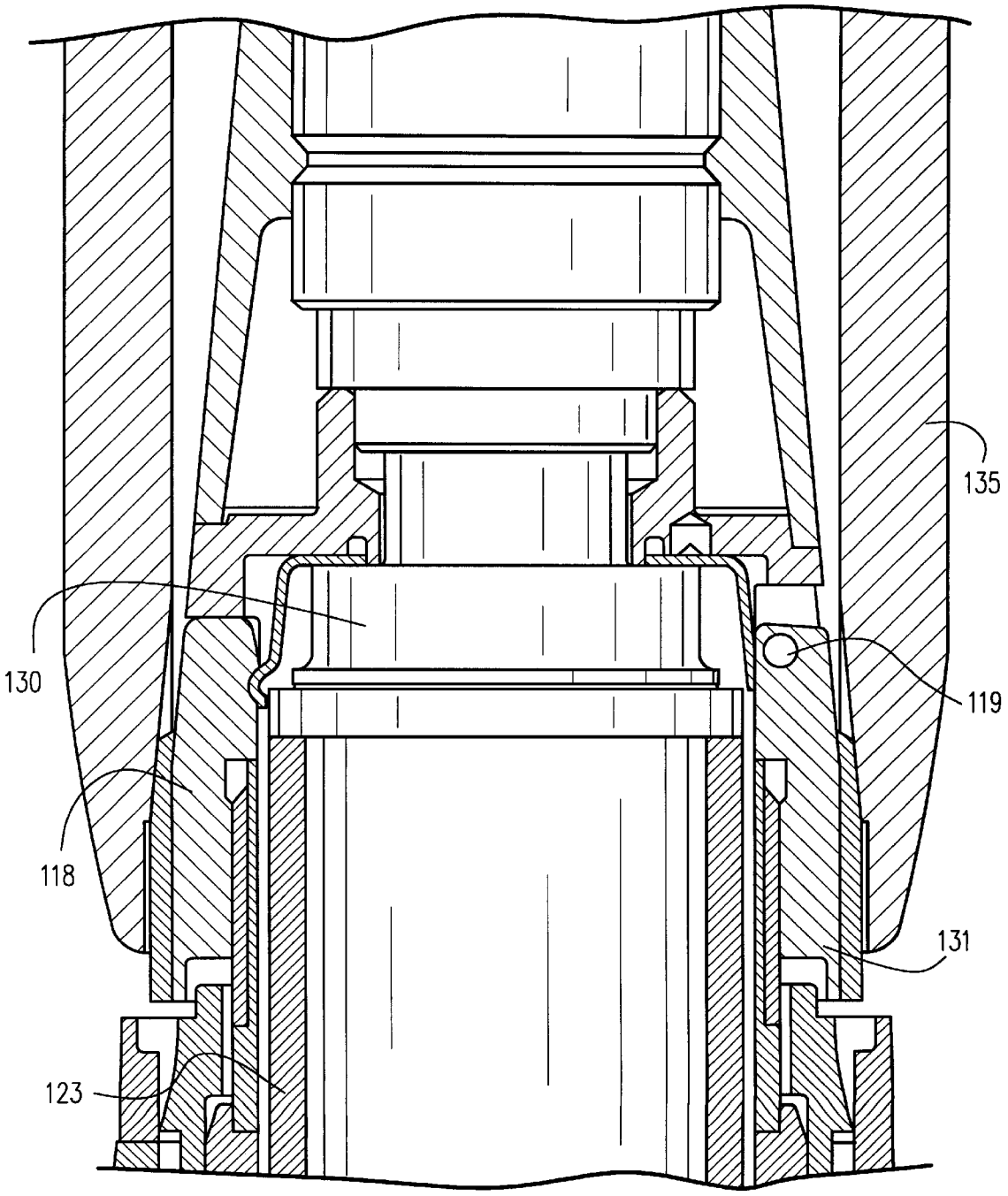
FIG. 9 is in an enlarged detail view of the abutment of the rear end of the ink cartridge against the fitting provided on the closure cap of the pen of FIG. 6.

The fountain pen of the embodiment of to FIGS. 6 to 8 is similar to the embodiment of FIGS. 1 to 5, and parts identical to those in FIGS. 1 to 5, or parts and elements whose function is the same as that of parts according to FIGS. 1 to 5, have the same reference numerals only increased by "100", and not all are described again.

In the embodiment of FIGS. 6 to 8, the intermediate sections 15*a*, 15*b* of the tracks 15, 16 in the positioning sleeve 14, provided in the embodiment according to FIGS. 1 to 5 and shown in FIG. 5, which define the storage position of the ink guide 5, 5', are missing. Furthermore, the ink guide 105 is represented in simplified form in the embodiment of FIGS. 6 to 8, and the bushing fitted onto the ink guide 105 comprises or consists essentially of an inner bushing 111 which surrounds the rear end 107 of the ink guide 105 and forms the receiving projection for the ink cartridge 123, and an external bushing 111' which is firmly connected to the inner bushing 111, and at which the catches 112, 113, lying opposite each other and projecting radially outwardly are formed. The external bushing part 111' also forms a cylindrical guide section for the front area of the ink cartridge 123.

In the FIGS. 6 to 8 embodiment, the ink guide 105 is shown in the storage position already described in connection with FIG. 2. In this position, the rear end of the ink cartridge 123 lies against the end of a fitting or insert 130 which is fitted onto the closure cap 120 which can be pivoted about the pivot axis 119. This abutment defines the storage position and, when the ink guide 105 is moved from the writing position into the storage position, causes a resistance or detent detectable by the user, which signals that the storage position has been reached.

The fountain pen according to FIGS. 6 to 8 has, in the front end area of the barrel 101, not only a front external thread 104 corresponding to the external thread of the fountain pen according to FIGS. 1 to 5, but in addition, in the rear end area (namely on the sleeve element 118 to which the closure cap 120 is linked so that it can pivot), a rear external thread 131. The sleeve element 118, in the same way as the sleeve element 18 of the fountain pen according to FIGS. 1 to 5, is non-rotatably connected to the positioning sleeve 114 which is rotatable but non-displaceable (that is, not linearly movable) in the barrel 101. Rotation of the sleeve element 118 therefore effects rotation of the positioning sleeve 114 and thus substantially linear movement of the ink guide 105 in the manner described in connection with the fountain pen of FIGS. 1 to 5.

The fountain pen according to FIGS. 6 to 8 has a cover cap 135 to which a clip 136 is attached in a conventional manner and Into which a likewise conventional sealing element 138 is fitted. The cover cap 135 can be screwed onto the front external thread 104 of the barrel 101 by the internal thread 132 provided in its front end area (FIG. 7). As can be seen from FIG. 8, the external diameter of the internal thread 132 decreases from front to back, the opening angle (twice β) of the thus-formed frustoconical portion being between about 10–16°, about 12° in FIG. 7. The core diameter of the front external thread 104 tapers accordingly from back to front, while the core diameter of the rear external thread 131 is substantially constant.

To give the fountain pen a comfortable length for the user when writing, the cover cap 135 is screwed onto the rear external thread 131. This is normally carried out substantially immediately after the cover cap 135 is removed from the front end of the barrel 101, that is when the ink guide 105 is in the storage position portrayed in the drawings. When the cover cap 135 is screwed onto the rear external thread 131 (FIGS. 7 and 8), as a result of the "frustoconical" design of the internal thread 132 of the cover cap 135, an increasing resistance to screw-on results until this resistance has increased to the extent that the sleeve element 118 is now turned together with the cover cap 135 and thereby the positioning sleeve 114 is twisted and the ink guide 105 is moved substantially linearly forwardly into the writing position. If the writing position described in connection with FIG. 1 is reached, i.e. the ink feed 105 cannot be moved forward any further, the force then still normally exerted by the user effects a further slight screwing of the cover cap 135 onto the rear external thread 131 and thus a further increase in the clamping force between the "frustoconical" internal thread 132 of the cover cap 135 and the rear external thread 131.

If the user moves the ink guide 105 back into the storage position by rotating the cover cap 135 engaging the rear external thread 131, the clamping force prevailing between the internal thread 132 of the cover cap 135 and the rear external thread 131 insures that the ink guide 105 is only substantially linearly moved from the writing position into the storage position, but the cover cap 135 is not detached from the sleeve element 118 and leaves the ink guide 105 in a position between the writing position and storage position. The cover cap 135 is separated from the rear external thread 131 only if, through the abutment of the rear end of the ink cartridge 123 against the fitting 130 of the closure cap 120 and thus when the storage position has been reached, the resistance against further displacement of the ink guide 105 increases such that the clamping force between the internal thread 132 of the cover cap 135 and the rear external thread 131 is overcome and the cover cap 135 detached.

In order (when the clamping action is relatively greater between the internal thread 132 of the cover cap 135 and the rear external thread 131) to prevent the rear end of the ink cartridge 123 from exerting, upon movement of the ink guide 105 into the storage position, a force on the fitting 130 of the closure cap 120 such that the closure cap 120 is displaced in the direction of its opening position about the pivot axis 119 (i.e. there is no precisely defined storage position), a co-axially extending support pin 137 sits in the sealing fitting 138. Pin 137 is located, as can be seen in FIG. 6, when the cover cap 135 is screwed onto the rear external thread 131, with its free end directly adjacent to the rear surface of the closure cap 120. In this way, pin 137 prevents the closure cap 120 from pivoting in to its open position (FIG. 3) and thus ensures a precisely defined storage position for the ink guide 105.

The support pin 137 also serves to secure the ink guide 105 against forward substantially linear movement when the cover cap 135 is screwed onto the front external thread 104 (FIG. 7). To this end, a co-axial blind bore is located in the ink guide 105, or a cut-out section 139, whose base surface lies opposite the free end of the support pin 137. If the user displaces the ink guide 105 forward by rotating the closure cap 120 when the cover cap 135 is screwed onto the front external thread 104, the base surface of the blind bore 139 comes to rest against the free end of the support pin 137 and blocks further displacement of the ink guide 105 toward the writing position before the tip of the nib 110 can come into contact with the base of the cover cap 135, in this case the base of the sealing fitting 138. Thus, damage to the tip of the nib 110 is avoided, and in particular, contact between the tip of the nib 110 and the base of the sealing fitting 138 over an extended period of time is substantially prevented so that a capillary path will not be formed by which ink from the nib 110 would constantly enter the inside of the cover cap 135.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A fountain pen comprising:

a tubular barrel having an open front end, and an open rear end;

a ink guide positioned in said barrel and having a front end and a rear end;

a nib attached to said front end of said ink guide and having a tip;

an ink cartridge removably attached to said rear end of said ink guide; and said ink guide mounted with respect to said barrel so that ink guide is substantially linearly movable between: a writing position, in which said nib tip projects out of said open front end of said barrel; a detented storage position, in which said nib is retracted into said barrel and a user is given a positive indication that the ink guide is in a positive storage position; and a replacement position different than said storage position, in which said replacement position a portion of said ink cartridge projects outwardly from said open rear end of the barrel so that said cartridge can be readily grasped and removed, and said nib is positioned differently than in said storage position.

2. A fountain pen as recited in claim 1 further comprising a positioning sleeve positioned so that it is rotatable, but not linearly movable, in said barrel, said positioning sleeve having a thread-like track; and at least one catch which is non-linearly movably connected to said ink guide, said catch engaging said thread-like track.

3. A fountain pen as recited in claim 2 wherein said track comprises a double thread, and wherein said ink guide has two catches disposed diametrically opposite to each other thereon for engaging said threads of said track.

4. A fountain pen as recited in claim 2 further comprising an external thread provided on said barrel front end, and a cover cap having an internal thread for cooperating with said external thread for surrounding said barrel front end.

5. A fountain pen as recited in claim 4 further comprising a rear external thread provided on said rear end of said positioning sleeve, for receiving said cover cap.

6. A fountain pen as recited in claim 5 wherein the core diameter of at least one of said rear external thread and said external diameter of said internal thread of said cover cap, changes in the axial direction so that the clamping force established between said positioning sleeve and said cover cap when screwed thereon is greater than the force to be exerted on said cover cap to substantially linearly move said ink guide from said writing position to said storage position.

7. A fountain pen as recited in claim 6 wherein said external diameter of said internal thread of said cover cap reduces from the front to back so that a frustoconical section is provided with an opening angle between about 10–16°, and said core diameter of said rear external thread is substantially constant.

8. A fountain pen as recited in claim 7 wherein said core diameter of said front external thread reduces from rear to front with essentially the same pitch as the external diameter of said internal thread of said cover cap.

9. A fountain pen as recited in claim 1 further comprising a closure cap pivotally mounted adjacent said barrel rear end to pivot into a position closing said barrel rear end.

10. A fountain pen as recited in claim 3 wherein said storage position is defined by the abutment of said rear end of said ink cartridge against a front surface of said closure cap.

11. A fountain pen as recited in claim 2 further comprising a positioning sleeve mounted so that it is rotatable with respect to, but axially immovable, in said barrel, said positioning sleeve having a rear external thread for receiving a cover cap; and further comprising an axially extending support pin provided in said cover cap and having a free end directly adjacent a rear surface of said closure cap when said cover cap is screwed onto said rear external thread and preventing said closure cap from opening as a result of pressure exerted on said closure cap by said ink cartridge.

12. A fountain pen as recited in claim 11 further comprising a front external thread adjacent said front end of said barrel for receiving said cover cap; and when said cover cap is screwed onto said front external thread a free end of said support pin engages a supporting surface of said ink guide when in said writing position, in a manner bracing said ink guide against further forward substantially linear movement, so that said tip of said nib is maintained spaced from all portions of said cover cap.

13. A fountain pen as recited in claim 12 wherein said supporting surface is provided by a base surface of a blind bore provided in said ink guide.

14. A fountain pen comprising:

a tubular barrel having an open front end, and an open rear end;

a ink guide positioned in said barrel and having a front end and a rear end;

a nib attached to said front end of said ink guide and having a tip;

an ink cartridge removably attached to said rear end of said ink guide;

said ink guide mounted with respect to said barrel so that ink guide is substantially linearly movable between: a writing position, in which said nib tip projects out of said open front end of said barrel; a storage position, in which said nib is retracted into said barrel; and a replacement position, in which a portion of said ink cartridge projects outwardly from said open rear end of the barrel so that said cartridge can be readily grasped and removed;

a positioning sleeve positioned so that it is rotatable, but not linearly movable, in said barrel, said positioning sleeve having a thread-like track; and at least one catch which is non-linearly movably connected to said ink guide, said catch engaging said thread-like track;

a closure cap pivotally mounted adjacent said barrel rear end to pivot into a position closing said barrel rear end; and wherein said closure cap is fastened to said rear end of said positioning sleeve.

15. A fountain pen comprising:

a tubular barrel having an open front end, and an open rear end;

a ink guide positioned in said barrel and having a front end and a rear end;

a nib attached to said front end of said ink guide and having a tip;

an ink cartridge removably attached to said rear end of said ink guide;

said ink guide mounted with respect to said barrel so that ink guide is substantially linearly movable between: a writing position, in which said nib tip projects out of said open front end of said barrel; a storage position, in which said nib is retracted into said barrel; and a replacement position different than said storage position, in which said replacement position a portion of said ink cartridge projects outwardly from said open rear end of the barrel so that said cartridge can be readily grasped and removed, and said nib is positioned differently than in said storage position;

a positioning sleeve positioned so that it is rotatable, but not linearly movable, in said barrel, said positioning sleeve having a thread-like track; and at least one catch which is non-linearly movably connected to said ink guide, said catch engaging said thread-like track.

16. A fountain pen as recited in claim 15 wherein said at least one catch is provided on a bushing which is attached to said rear end of said ink guide.

17. A fountain pen as recited in claim 15 further comprising a supporting surface for said at least one catch, said supporting surface provided on said front end of said track.

18. A fountain pen as recited in claim 15 wherein said track has at least one section which has a reduced pitch and defines said storage position.

19. A fountain pen as recited in claim 15 further comprising a closure cap pivotally mounted adjacent said barrel rear end to pivot into a position closing said barrel rear end; and wherein said closure cap is fastened to said rear end of said positioning sleeve.

20. A fountain pen as recited in claim 15 wherein said track comprises a double thread, and wherein said ink guide has two catches disposed diametrically opposite to each other thereon for engaging said threads of said track.

21. A fountain pen as recited in claim 20 wherein said catches are provided on a bushing which is attached to said rear end of said ink guide.

* * * * *